US005272904A

United States Patent [19]

Krumholz

[11] Patent Number: 5,272,904

[45] Date of Patent: Dec. 28, 1993

[54] HYDRAULICALLY OPERABLE PRESS BRAKE

[75] Inventor: Waldemar Krumholz, Hinwil, Switzerland

[73] Assignee: M + S Brugg AG, Brugg, Switzerland

[21] Appl. No.: 971,287

[22] Filed: Nov. 4, 1992

[30] Foreign Application Priority Data

Nov. 21, 1991 [DE] Fed. Rep. of Germany ..... 4138285

[51] Int. Cl.[5] ..... B21J 13/04; B21D 5/02

[52] U.S. Cl. ..... 72/455; 72/389; 100/258 R; 100/269 R

[58] Field of Search ..... 100/236, 258 R, 258 A, 100/269 R; 72/456, 450, 455, 389, 453.06

[56] References Cited

U.S. PATENT DOCUMENTS 2,377,007 5/1945 Hess ..... 100/258 R
3,163,105 12/1964 Pearson ..... 100/258 R
3,852,991 12/1974 Poggio ..... 72/389
4,873,923 10/1989 Manning ..... 100/269 R

FOREIGN PATENT DOCUMENTS 275139 4/1913 Fed. Rep. of Germany ... 100/258 R

*Primary Examiner*—David Jones
*Attorney, Agent, or Firm*—Tarolli, Sundheim & Covell

[57] ABSTRACT

The press brake of the invention comprises a cross bar-like pressure ram member. The two lateral ends thereof are connected each to the piston rod of a pressure bar operating cylinder. For transmitting the power exerted by the operating cylinder, there is provided an articulated joint assembly with two articulated joints which are arranged in series as seen in the power transmission direction. Thereby, a complete absence of clearance in the pressure ram driving elements can be realized and higher tolerances as far as the parallelism of the two operating cylinders can be accepted. Furthermore, an operational tilting of the pressure ram member with relatively high tilting angle is possible.

15 Claims, 3 Drawing Sheets

HYDRAULICALLY OPERABLE PRESS BRAKE

FIELD OF THE INVENTION

The present invention refers to a hydraulically operated press brake comprising a frame structure, a pressure ram member mounted in the frame structure to be vertically movable, a stationary work table mounted in the frame structure, first and second pressure ram operating means each comprising a hydraulic cylinder, a piston and a piston rod and mounted in the frame structure for driving the pressure ram member to a motion against said work table and for retracting it vertically back from the work table, and first connecting means for operatively connecting the first operating cylinder to the pressure ram member in the region of the one lateral end thereof and second connecting means for operatively connecting the second operating cylinder to the pressure ram member in the region of the other lateral end thereof.

PRIOR ART

In know press brakes of the kind referred to hereinabove, the connecting means for operatively connecting the operating cylinders to the pressure ram member and thereby transmitting the pressure force from the operating cylinders to the pressure ram member are constituted as simple single articulated joint power transmitting assemblies.

In such a design of a linearly movable pressure ram member to which the pressure force is pointwisely exerted essentially at the two lateral end sides, the problem occurs of attaining an exact parallelism of the two induced pressure power vectors and thereby of the guidance of the two piston rods transmitting the power of the operating cylinders to the pressure ram member, respectively. Inaccuracies in this respect result in excessively high guiding forces in the guiding bearings as well as in the elements of the power transmitting articulated joints during the operating stroke of the pressure ram member, with the result that the life span of these parts and elements is shortened and that, in the worst case, the pressure ram member is jammed.

In order to avoid such operational disadvantages, it is necessary to provide for a very high manufacturing precision of all cooperating elements and especially of the mounting elements for the operating cylinders to ensure an absolutely parallel mutual position of the operating cylinders and an exact alignment with respect to the stationary work table. But just this requirement to machine these mounting elements for the operating cylinders and, consequently, also the matching elements of the frame structure of the press brake very precisely requires a great effort and considerable expenditure. Particularly in the case of very big press brakes having a working area with a width of several meters, it is practically nearly impossible to reach the desired accuracy as far as the parallelism of the operating cylinders and, thereby, the parallelism of the induction of the pressure force to the pressure ram member is concerned, if economical aspects of manufacture also have to be considered.

In the prior art, one has tried keep the aforementioned inaccuracies within certain limits and to compensate for these inaccuracies by the provision of a certain clearance in the articulated joints between the piston rods of the operating cylinders and the pressure ram member as well as in the guiding elements for the piston rods. The disadvantage of these measures is that the pressure ram member can come in an oblique position due to the clearances in the articulated joints and in the guiding means of the piston rods, particularly if the pressure ram member is unevenly loaded during the operating stroke. The result are inaccuracies in the processed work piece which can not be accepted. Furthermore, there is the danger that the guiding forces rise too much in the event of a tilted pressure ram member during the operating stroke as soon as the clearance reduces.

On the other hand, there is a need to provide for a tilted position of the pressure ram member for certain working operations. If there is provided enough clearance in the connecting means between operating cylinders and pressure ram member, basically this possibility is given. However, the tilt angle achievable under such conditions usually is too small. In addition, one had to accept the disadvantages discussed hereinabove which are caused by the provision of a relatively high amount of clearance in the connecting means between operating cylinders and pressure ram member.

OBJECTS OF THE INVENTION

It is an object of the present invention to provide a hydraulically operated press brake of the kind mentioned hereinbefore which does not show the disadvantages of press brakes known in the art.

It is a further object of the present invention to provide a hydraulically operated press brake of the kind mentioned hereinbefore which operates in every operation mode with a clearance-free transmission of the pressure power from the operating cylinders to the pressure ram member.

It is a still further object of the present invention to provide a hydraulically operated press brake of the kind mentioned hereinbefore which allows for a simpler and less expensive design and construction of the frame structure of the press brake and nevertheless operates more accurately than similar press brakes known in the art.

Finally, it is a still further object of the present invention to provide a hydraulically operated press brake of the kind mentioned hereinbefore which allows for an operation of the pressure ram member is a tilted position with a relatively high tilting angle without any loss of working precision.

SUMMARY OF THE INVENTION

To achieve these and other objects, the invention provides a a hydraulically operated press brake comprising a frame structure, a pressure ram member mounted in the frame structure to be vertically movable, a stationary work table mounted in the frame structure, first and second pressure ram operating means each comprising a hydraulic cylinder, a piston and a piston rod and mounted in the frame structure for driving the pressure ram member to a motion against said work table and for retracting it vertically back from the work table, and first connecting means for operatively connecting the first operating cylinder to the pressure ram member in the region of the one lateral end thereof and second connecting means for operatively connecting the second operating cylinder to the pressure ram member in the region of the other lateral end thereof.

According to the invention, the first and second connecting means each comprise a first articulated joint for carrying and guiding the pressure ram member and second articulated joint means comprising a double articulation including two articulated joints arranged in series as seen in the direction of operation of the operating cylinders for transforming the pressure exerted by the pressure ram operating cylinders to the pressure ram member, whereby the axes of all articulations run essentially perpendicular to the plane in which the pressure ram member is moved.

The double articulated joint means can be constituted by cylindrical articulated joints or spherical articulated joints like ball-and-socket joints.

The double articulated joint means allows for a clearance-free connection of the piston rod of the operating cylinder with the pressure ram member as compared with simple single articulated joint assemblies with the result that an undesired tilting of the pressure ram member during the operating stroke is avoided. Furthermore, a much higher tolerance is admissible as far as the parallelism of the induced pressure power vectors is concerned. This means that a reduced accuracy in mounting the operating cylinders in the frame structure of the press brake may be accepted; in some cases, an expensive machining of the mounting elements for the operating cylinders and the corresponding counterparts on the frame structure of the press brake can be omitted.

Furthermore, due to the provision of a double articulated joint assembly, excessive guiding forces are avoided. Finally, an operative tilted position of the pressure ram member during the working stroke can be realized at will with a relatively high tilting angle without a considerable increase of the guiding forces. Due to the absence of any clearances of the active elements, a preselected tilted position of the pressure ram member during the working stroke of the pressure ram member can be maintained, independent of the evenness of the load exerted to the pressure ram member.

According to a preferred embodiment, the articulated joint means comprises a first articulation head connected to the piston rod of the related pressure ram member operating cylinder, a second articulation head connected to the related lateral end of the pressure ram member, as well as a two-sided articulation pan interposed between the first and second articulation heads and being freely movable, whereby the first and second articulation heads are made of brass and the two-sided articulation pan is made of steel, particularly of cast steel.

In a preferred embodiment, the first articulation head has an even top surface which rests on an even front surface of the piston rod of the related pressure ram member operating cylinder, and the second articulation head has an even lower surface which rests on an even top surface of the pressure ram member, whereby the even top surface of the first articulation head and the even front surface of the piston rod each have correspondingly located first recesses in which a first common aligning pin is inserted. Furthermore, the even lower surface of the second articulation head and the even top surface of the pressure ram member each have correspondingly located second recesses in which a second common aligning pin is inserted. Thereby, it is ensured that the first and second articulation head cannot be radially displaced with respect to the associated piston rod and pressure ram member, respectively.

If the first articulated joint of the first and second connecting means comprises a carrier member, one end thereof being pivotally connected to the piston rod of the pressure ram operating cylinder and the other end thereof being pivotally connected to the pressure ram member, the design may be such that the articulation axes of the articulation heads connected to the piston rods of the pressure ram operating cylinder and to the pressure ram member, respectively, coincide with the pivot axes of the one end of the carrier member pivotally connected to the piston rod of the pressure ram operating cylinder and the other end pivotally connected to the pressure ram member, respectively.

Preferably, the carrier members each comprise a sprag clutch means which becomes effective during the pressure stroke of the pressure ram member in order to relieve the carrier members from the pressing forces during the working stroke of the pressure ram member. Furthermore, the sprag clutch means of the carrier members can comprise spring means whereby the force exerted by the spring means is such that the pressure ram member, in its no-load condition, is slightly pressed against the piston rods of the pressure ram operating cylinders.

In a first embodiment of the carrier members, each carrier member comprises a first portion and a second portion which are connected together by means of connecting bolts such that the two portions are displaceable against each other. According to a second embodiment, each carrier member comprises a bolt, one end thereof being pivotally connected to a first pivot shaft provided on the piston rod of the pressure ram operating cylinder and the other end thereof slidably penetrating a bore in a second pivot shaft provided on the pressure ram member, the other end of said bolt being provided with a stop nut.

In order to prevent a horizontal displacement of the pressure ram member with regard to the stationary work table, which would be possible due to the design of the double articulated joint assemblies, a central pivot is provided on the pressure ram member and located in the height of the operating cylinders. It is movable along a linear slide guide means. Thus, the pressure ram member always takes a well defined position, not only if it is parallely adjusted vis-à-vis the work table, but also if it is tilted in any arbitrary direction. By the provision of the aforementioned central pivot guided in the linear slide guide means the lateral deviation of the tilted pressure ram member with regard to the operating cylinders is kept within narrow limits and is evenly distributed to both lateral sided of the press brake.

BRIEF DESCRIPTIONS OF THE DRAWINGS

In the following an embodiment of the invention will be further described, with reference to the accompanying drawings, in which.

DETAILED DESCRIPTION OF A PREFERRED EMBODIMENT

Figure 2:
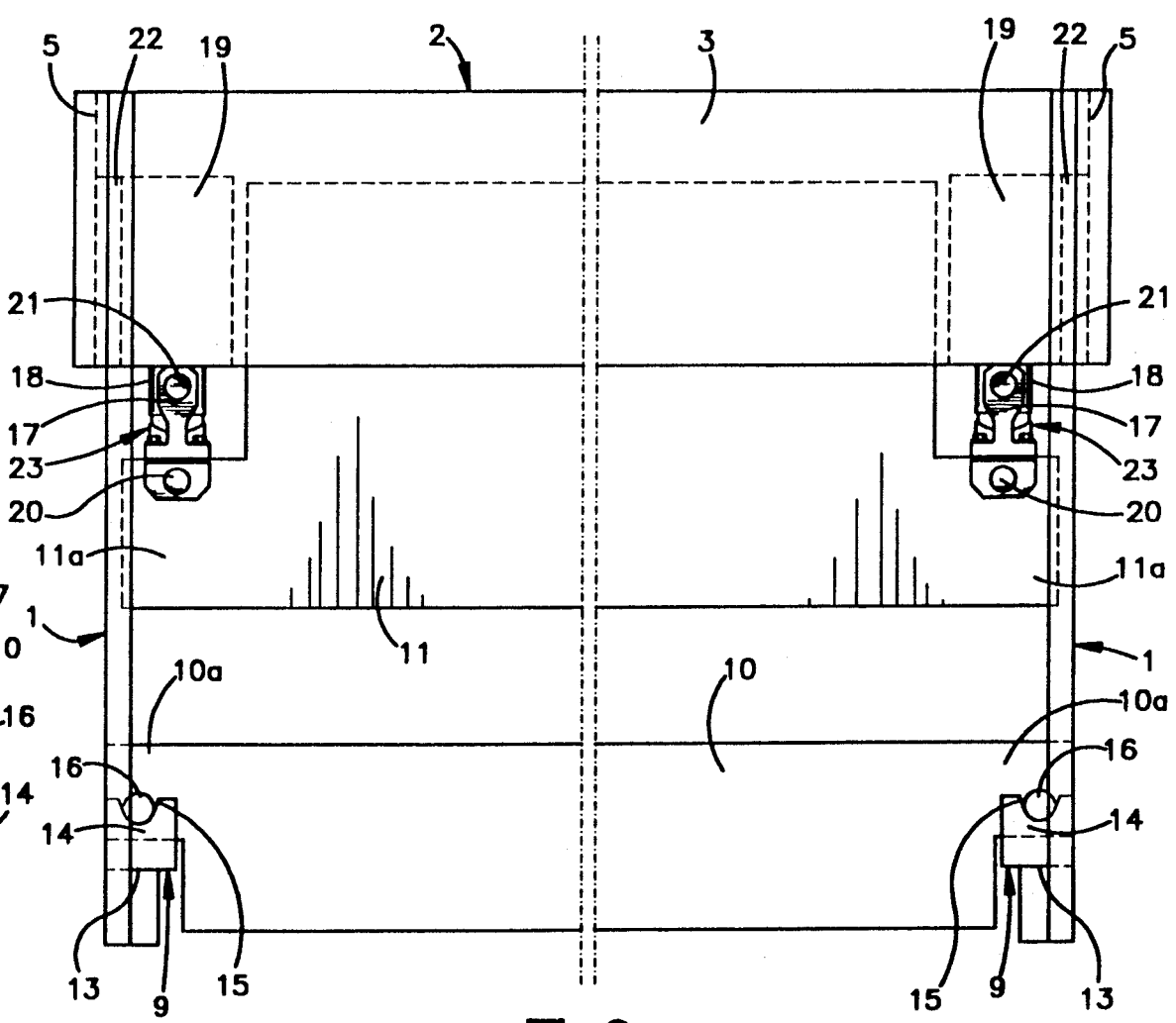
FIG. 2 shows a schematic front view of an embodiment of the press brake according to the invention, whereby only the two lateral portions thereof are shown.
Figure 1:
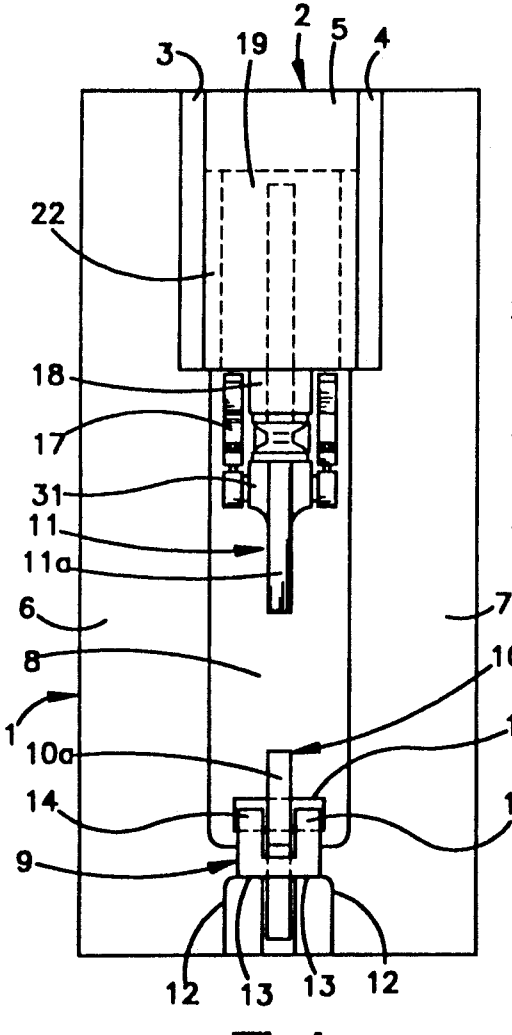
FIG. 1 shows a schematic side view of an embodiment of the press brake according to the invention.

As can be seen in FIGS. 1 and 2, the press brake comprises a frame structure, essentially including two vertically extending lateral support members 1 and a cross beam 2 extending in horizontal direction and interconnecting the upper ends of the two vertical support members 1. The cross beam 2 has a box-like design and comprises two vertically extending longitudinal plate members 3 and 4, the two ends of them being interconnected by means of a vertically extending cross plate member 5. The lateral support members 1 each comprise two upright plate members 6 and 7 which are arranged in a certain distance from each other to leave a free space 8 between them. The plate members 6 and 7 are interconnected at their top by the cross beam 2 and at their bottom by means of a connecting member 9.

The active elements of the press brake are essentially constituted by a stationary work table 10 and a vertically displaceable pressure ram member 11. Both the work table 10 and the pressure ram member 11 extend in horizontal direction between the two lateral support members 1 of the frame structure of the press brake into the free space 8 between the two plate members 6 and 7. It is understood that the work table 10 and the pressure ram member 11 are equipped with bending tools which are not shown in the drawings.

The connecting member 9 rests on a shoulder 13 of the plate members 6 and 7 reinforced by a reinforcement member 12 and serves not only, as already mentioned for interconnecting the two plate members 6 and 7, but also as a support for the work table 10 which is generally designed as freely supported cross member. For this purpose, each one of the two connecting members 9 comprises two support members 14 mounted in a certain distance from each other on the corresponding connecting member 9 and being provided each with a bearing shell 15 having a concave cylindrical surface. The two lateral ends of the work table 10 have portions 10*a* protruding into the space between the support members 14; these portions 10*a* are provided with a cylindrical gudgeon pin 16 having two protruding ends resting in the bearing shells 15 of the support members 14.

The frame structure of the press brake is provided with two hydraulic cylinders 19 each comprising a piston (not shown) and a piston rod 18 for operating the pressure ram member 11 to a motion towards and away from the work table 10. These operating cylinders 19 are located in the region of the two lateral ends of the frame structure of the press brake and comprise each a mounting flange 22 which is rigidly connected to the adjacent cross plate member 5 of the cross beam 2. The pressure ram member 11 has two laterally protruding portions 11*a*. The pressure ram member 11 is suspended on the two piston rods 18 of the operating cylinders 19 by means of two carrier members 17. Each carrier member 17 has an upper end which is pivotally connected to the piston rod 18 of the related operating cylinder 19, and a lower end which is pivotally connected to the protruding portion 11*a* of the pressure ram member 11. The pivot shaft connecting the lower end of the carrier member 17 to the pressure ram member 11 is designated with reference numeral 20, while the pivot shaft connecting the upper end of the carrier member 17 to the piston rod 18 of the operating cylinder is designated with reference numeral 21.

In order to transmit the pressure exerted by the piston rods 18 of the operating cylinders 19 to the pressure ram member 11, there is provided a pressure transmitting joint in the form of a double articulation assembly 23. Details regarding the design and construction of the double articulation assembly 23 and the carrier members 17 are shown in FIGS. 3 and 4 and will be further explained hereinafter.

Figure 3:
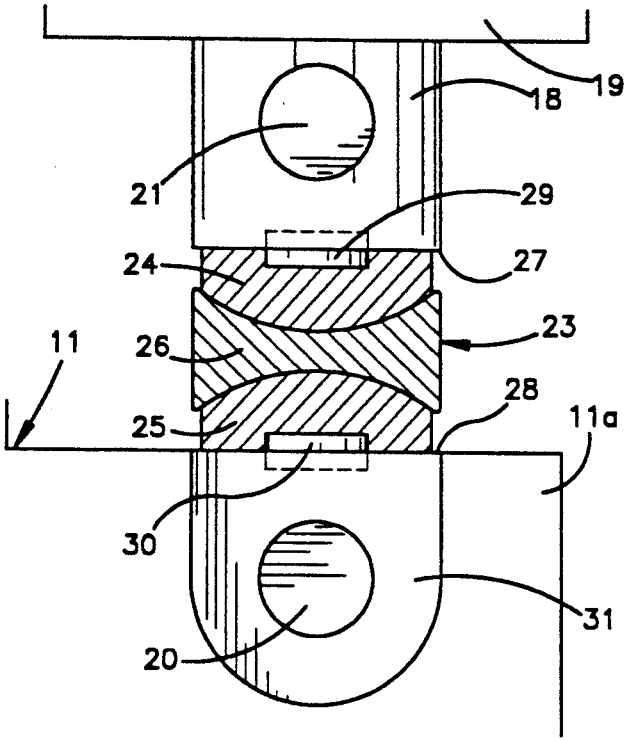
FIG. 3 shows a partial sectional view of a double articulation in a large scale.
Figure 4:
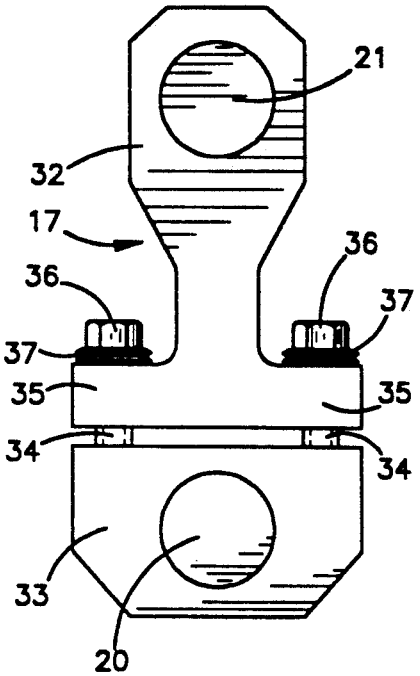
FIG. 4 shows a front view of a first embodiment of a carrier member in a large scale.

FIG. 3 shows a partial sectional view of a double articulation assembly 23 in a larger scale. The section plane, thereby, extends parallel to the plane in which the pressure ram member 11 is moved towards and away from the work table 10.

The pressure transmitting joint constituted by the double articulation assembly 23 comprises two articulations connected in series as far as the transmission of the pressure power is concerned. Particularly, there is provided a first articulation head 24 connected to the piston rod 18 of the related operating cylinder 19, a second articulation head 25 connected to the protruding portion 11*a* of the pressure ram member 11 and a double-sided articulation pan 26 interposed between the two articulation heads 24 and 25. Due to the section plane selected in FIG. 3, this FIG. 3 is correct and applicable both for a cylindrical articulated joint with articulation axes running perpendicular to the plane in which the pressure ram member 11 is moved as well as for a ball-and-socket joint.

Thus, the cooperating surfaces, on the one hand, of the first articulation head 24 and the interposed articulation pan 26 and, on the other hand, the interposed articulation pan 26 and the second articulation head 25, can be either of cylindrical or of spherical configuration. Particularly, according to a first embodiment, the surfaces of the first and second articulation heads 24 and 25, respectively, facing the articulation pan 26 have convex cylindrical shape and the two opposite surfaces of the articulation pan 26 have corresponding concave cylindrical shape, whereby the axes of the related cylinders all run perpendicularly to the plane in which the pressure ram member 11 is moved. According to a second embodiment, the surfaces of the first and second articulation heads 24 and 25, respectively, facing the articulation pan 26 have convex spherical shape and the two opposite surfaces of the articulation pan 26 have corresponding concave spherical shape, thereby forming a double ball-and-socket joint.

In a preferred embodiment, the first and second articulation heads 24 and 25, respectively, are made of brass and the two-sided articulation pan 26 is made of steel, particularly of cast steel.

The first articulation head 24 has an even top surface which rests on an even front surface 27 of the piston rod 18 of the related pressure ram member operating cylinder 19. The second articulation head 25 has an even lower surface which rests on an even top surface 28 of the portion 11*b* of the pressure ram member 11. The even top surface of the first articulation head 24 and the even front surface 27 of the piston rod 18 each have correspondingly located first recesses in which a first common aligning pin 29 is inserted. The even lower surface of the second articulation head 25 and the even top surface 28 of the portion 11*b* of the pressure ram member 11 each have correspondingly located second recesses in which a second common aligning pin 30 is inserted. Thereby, the first articulation head 24 is prevented from radially moving away from the piston rod 18, and the second articulation head 25 is prevented from radially moving away from the protruding portion 11*b* of the pressure ram member 11.

The even top surface 28 of the protruding portion 11*a* of the pressure ram member 11 is adapted to the diameter or size of the second articulation head 25 by means of a reinforcement portion 31 fixed to the portion 11*a* of the pressure ram member 11.

A first embodiment of a carrier member 17 used to suspend the pressure ram member 11 on the piston rods 18 of the operating cylinders 19 and thereby bridging the pressure transmitting joint constituted by the double articulated joint assembly 23 is shown in FIG. 4. As can be seen in the drawing, the carrier member 17 is divided in the direction of power transmission into two parts, i.e. into an upper portion 32 pivotally connected to the pivot shaft 21 provided on the piston rod 18 of the operating cylinder 19 (cf. FIG. 3), and a lower portion 33 pivotally connected to the pivot shaft 20 provided on the protruding portion 11*a* of the pressure ram member 11. The upper portion 32 and the lower portion 33 are loosely connected to each other by means of screw bolts 34 which freely penetrate the sideways directed legs 35 of the upper portion 32 and which are screwed into the lower portion 33. Between the heads 36 of the screw bolts 34 and the legs 35 of the upper portion, spring members 37, e.g. disk springs, are inserted. These spring members 37 exert a force onto the lower portion 33 of the carrier member 17 via the heads 36 and the screw bolts 34 such that the lower portion 33 is pulled against the upper portion 32. The spring force is selected such that the elements 24, 25 and 26 of the power transmitting articulated joint assembly 23 are slightly pressed together if the pressure ram member 11 is in a no-load condition, e.g. during fast forward or retraction of the pressure ram member 11.

The loose interconnection of the two portions 32 and 33 of the carrier member 17 forms a sprag clutch with the result that the pressure exerted by the piston rods 18 of the operating cylinders 19 is transmitted to the pressure ram member 11 only by the power transmitting articulated joint assembly 23 during the working stroke of the pressure ram member 11. Thereby, the carrier members 17 and their associated articulated joints are not subjected to any heavy strain by the pressure force.

Figure 5:
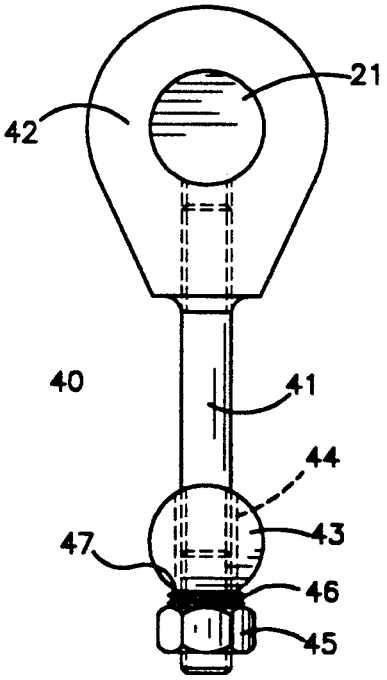
FIG. 5 shows a front view of a second embodiment of a carrier member in a large scale.

According to another embodiment shown in FIG. 5, the carrier member 40 comprises a bolt 41, one end thereof being rigidly connected, e.g. screwed or welded, to a sleeve member 42 which is pivotally connected to the pivot shaft 21 provided on the piston rod 18 of the related operating cylinder 19. The other end of the bolt 41 freely penetrates the other pivot shaft 43 provided on the protruding portion 11*b* of the pressure ram member 11 through a bore 44 and is equipped, at its free end, with a stop nut 45. Between a flattened portion 47 of the pivot shaft 43 and the stop nut 45, spring elements 46 are inserted. In this embodiment, the pivot shaft 43 is rotatably connected to the protruding portion 11*b* of the pressure ram 11, while in the case of the pivot shafts 20 and 21 the rotation bearing can be situated, as desired, on the protruding portion 11*a* of the pressure ram member 11 or at the carrier member 17 and at the sleeve 42 of the carrier member 40, respectively.

The centers of the power transmitting articulated joint assembly 23 coincide with the related axes of the pivot shafts 20 and 21 of the carrier member 17. In other words, the center of the articulation head 24 and the one of the assigned articulation pan surface of the double-sided articulation pan 26 coincides with the center of the pivot shaft 21 provided on the piston rod 18 of the related operating cylinder 19, and the center of the articulation head 25 and the one of the assigned articulation pan surface of the double-sided articulation pan 26 coincides with the center of the pivot shaft 20 provided on the protruding portion 11*a* of the pressure ram member 11. The result is that the distance between the pivot shafts 20 and 21 remains constant in every position of the power transmitting articulated joint assembly 23. Thus, if the power transmitting articulated joint assembly 23 is out of alignment, the related carrier member 17 is prevented from being subjected to any pull or push forces; this would not be true if the distance between the pivot shafts 20 and 21 is not constant.

The power transmitting articulated joint assembly 23 and the related articulated joint constituted by the carrier members 17 and 40, respectively, can be realized without any clearance. The result is that the press brake operates with a very high degree of accuracy. Thereby, only the aforementioned articulated joints and the not shown means for the parallel guidance of the pressure ram member 11 must be precisely machined. The position of the operating cylinders 19 and their vertical alignment is of less importance and there is no need for a high accuracy because any misalignment or positional deviation of the fixing means does not inevitably have an effect on the position or alignment of the pressure ram member 11, but is compensated for by the power transmitting articulated joint assemblies 23. Thus, the design and the manufacture of the frame structure of the press brake is considerably simplified and less expensive.

The guiding means for the pressure ram member 11 can be correctly adjusted to be in exact alignment with the work table 10 when the press brake is finally assembled, thanks to the compensating effect of the power transmitting articulated joint assemblies 23. In this respect, a spherical design of the power transmitting articulated joint is much more preferable than a cylindrical design because, thereby, the plane of the pressure ram member 11 can be adjusted in all directions due to the additional degree of freedom and can be precisely brought into the desired operating position independently from the exact position of the operating cylinders 19 by adjusting the guiding means for the pressure ram member 11.

Figure 6:
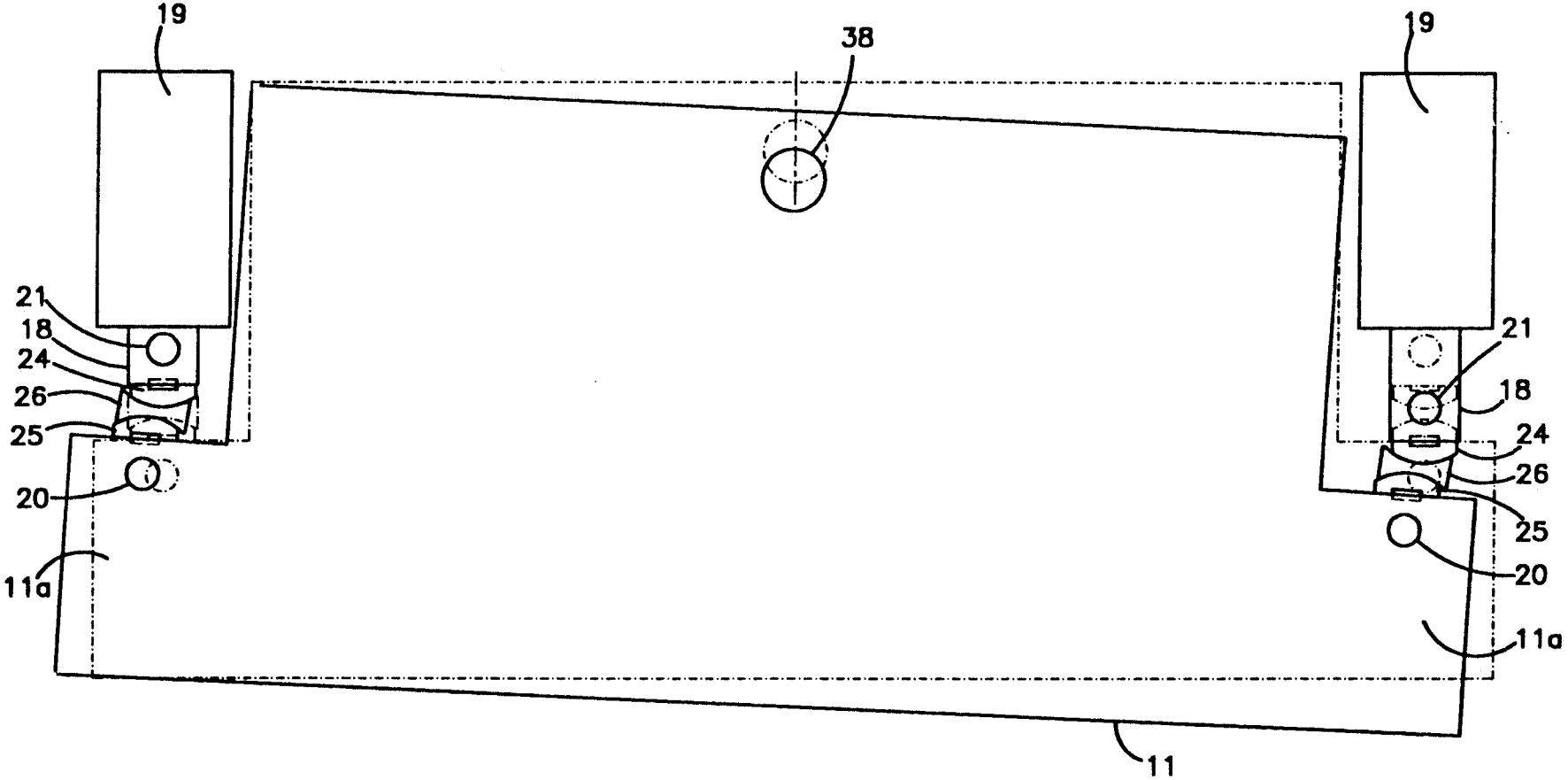
FIG. 6 shows a schematic partial view of the press brake with tilted pressure ram member.

Furthermore, due to the provision of the power transmitting double articulated joint assemblies 23 and without loss of the absence of any clearance, an operational obliquity of the pressure ram member 11 is possible to a high degree. Tests with a prototype of the press brake according to the invention have shown that the pressure ram member 11 can be tilted up to an angle of 15°. FIG. 6 schematically shows the mutual displacement of the elements 24, 25 and 26 of the double articulated joint assemblies 23 if the pressure ram member 11 takes an oblique or tilted position. In this Fig., the moving elements of the press brake are shown in dash-dotted lines if the pressure ram member 11 is horizontally aligned and in solid lines if the pressure ram member 11 is tilted. Thereby, the reference numerals refer to the tilted position.

Further shown in FIG. 6 is a central pivot 38 provided on the pressure ram member 11 and located in the height of the operating cylinders 19. It is movable along a not shown linear slide guide means. By this measure, a horizontal displacement of the pressure ram member 11 with regard to the stationary work table 10, which would be possible due to the design of the double articulated joint assemblies 23, is prevented such that the pressure ram member 11 always takes a well defined position, not only if it is parallely adjusted vis-à-vis the work table 10, but also if it is tilted in any arbitrary direction. Finally, it must be mentioned that by the provision of the aforementioned central pivot 38 guided in the linear slide guide means the lateral deviation of the tilted pressure ram member 11 with regard to the operating cylinders 19 is kept within narrow limits and is evenly distributed to both lateral sides of the press brake.

What is claimed is:

1. A hydraulically operated press brake comprising:

a frame structure;

a pressure ram member mounted in said frame structure to be vertically movable;

a stationary work table mounted in said frame structure;

first and second pressure ram operating means each comprising a hydraulic cylinder, a piston and a piston rod and mounted in said frame structure for driving said pressure ram member to a motion against said work table and for retracting said pressure ram member vertically back from said work table;

first connecting means for operatively connecting said first operating cylinder to said pressure ram member in the region of one lateral end thereof and second connecting means for operatively connecting said second operating cylinder to said pressure ram member in the region of another lateral end thereof;

said first and second connecting means each comprising a first articulated joint for carrying and guiding said pressure ram member and second articulated joint means comprising a double articulation including two articulated joints which are located one behind the other one as seen in a direction of operation of said operating cylinders for transmitting the pressure exerted by said pressure ram operating cylinders to said pressure ram member, whereby axes of all articulations run essentially perpendicular to a plane in which said pressure ram member is moved.

2. A press brake according to claim 1 in which each of said second articulated joint means comprises a first articulation head connected to said piston rod of said pressure ram member operating cylinder, a second articulation head connected to a respective lateral end of said pressure ram member, as well as a two-sided articulation pan interposed between said first and second articulation heads and being freely movable.

3. A press brake according to claim 2 in which said first and second articulation heads are made of brass and said two-sided articulation pan is made of steel.

4. A press brake according to claim 2 in which said first articulation head has a flat top surface which rests on a flat front surface of said piston rod of said pressure ram member operating cylinder, and in which said second articulation head has a flat lower surface which rests on flat top surface of said pressure frame member, whereby said flat top surface of said first articulation head and said flat front surface of said piston rod each having correspondingly located first recesses in which a first common aligning pin is inserted, and whereby said flat lower surface of said second articulation head and said flat top surface of said pressure ram member each have correspondingly located second recesses in which a second common aligning pin is inserted.

5. A press brake according to claim 2 in which surfaces of said first and second articulation heads facing said articulation pan have convex cylindrical shape and in which two opposite surfaces of said articulation pan have corresponding concave cylindrical shape, axes of the related cylinders all running perpendicularly to a plane in which said pressure ram member is moved.

6. A press brake according to claim 2 in which surfaces of said first and second articulation heads facing said articulation pan have convex spherical shape and in which two opposite surfaces of said articulation pan have corresponding concave spherical shape.

7. A press brake according to claim 1 in which each of said first articulated joint of said first and second connecting means comprises a carrier member, one end thereof being pivotally connected to said piston rod of said pressure ram operating cylinder and the other end thereof being pivotally connected to said pressure ram member.

8. A press brake according to claim 2 in which articulation axes of said articulation heads connected to said piston rods of said pressure ram operating cylinder and to said pressure ram member, respectively, coincide with pivot axes of the one end of said carrier member pivotally connected to said piston rod of said pressure ram operating cylinder and the other end pivotally connected to said pressure ram member, respectively.

9. A press brake according to claim 7 in which said carrier members each comprises clutch means which becomes effective during the pressure stroke of the pressure ram member.

10. A press brake according to claim 9 in which said clutch means of said carrier members comprises spring means.

11. A press brake according to claim 10 in which the force exerted by said spring means is such that said pressure ram member, in a no-load condition, is slightly pressed against said piston rods of said pressure ram operating cylinders.

12. A press brake according to claim 9 in which said carrier member comprises a first portion and a second portion which are connected together by means of connecting bolts such that the two portions are displaceable relative to each other.

13. A press brake according to claim 9 in which said carrier member comprises a bolt, one end thereof being pivotally connected to a first pivot shaft provided on said piston rod of said pressure ram operating cylinder and the other end thereof slidably penetrating a bore in a second pivot shaft provided on said pressure ram member, said other end of said bolt being provided with a stop nut.

14. A press brake according to claim 1 in which said pressure ram member comprises a central pivot located between said pressure ram operating cylinders and which is vertically displaceable in a linear slide guide means.

15. A press brake according to claim 2 in which said first and second articulation heads are made of brass and said two-sided articulation pan is made of cast steel.

* * * * *